United States Patent [19]

Akanuma et al.

[11] Patent Number: 4,571,002

[45] Date of Patent: Feb. 18, 1986

[54] HYDRAULIC ROCK SPLITTER

[75] Inventors: Shigetake Akanuma, Chigasaki; Satoshi Takashima, Kanagawa; Haruo Imamura; Yoshitaka Ojiro, both of Hiratsuka, all of Japan

[73] Assignee: Kabushiki Kaisha Komatsu Seisakusho, Tokyo, Japan

[21] Appl. No.: 608,684

[22] Filed: May 10, 1984

[51] Int. Cl.[4] ..... E21C 37/04

[52] U.S. Cl. ..... 299/22; 299/23

[58] Field of Search ..... 299/22, 23; 125/23 R; 403/80; 199/193 A, 193 C, 193 D

[56] References Cited

U.S. PATENT DOCUMENTS

| | | | |
|---|---|---|---|
| 2,814,475 | 11/1957 | Jay | 299/23 |
| 3,883,178 | 5/1975 | Darda | 299/22 |
| 3,995,906 | 12/1976 | Darda | 299/22 |
| 4,474,410 | 10/1984 | Ogaki et al. | 299/22 X |

*Primary Examiner*—James A. Leppink
*Assistant Examiner*—Thomas J. Odar
*Attorney, Agent, or Firm*—Armstrong, Nikaido, Marmelstein & Kubovcik

[57] ABSTRACT

Apparatus having a pair of presser cheeks for insertion in a drill hole, with a slider wedge slidably engaged therebetween. The forced descent of the slider wedge by a hydraulic cylinder assembly results in the lateral motion of the presser cheeks away from each other. The presser cheeks are supported from the cylinder body of the cylinder assembly, each via two pairs of parallel spaced leaf springs disposed on opposite sides of the slider wedge and normally closely held against the other two pairs of leaf springs supporting the other presser cheek. While the bottom ends of the leaf spring pairs are rigidly coupled to the presser cheeks, their upper ends are connected to the cylinder body via elastic members yieldable to permit upward displacement of the leaf springs with the presser cheeks, as upon withdrawal of the slider wedge, without buckling. Further two pairs of stop rods depend from the cylinder body so as to normally terminate short of the respective presser cheeks. As the elastic members yield to allow upward displacement of the leaf springs, the presser cheeks come into abutment against the respective pairs of stop rods to prevent the buckling and consequent destruction of the leaf springs.

4 Claims, 6 Drawing Figures

HYDRAULIC ROCK SPLITTER

BACKGROUND OF THE INVENTION

This invention relates to apparatus for splitting or breaking up rock, and more specifically to such a rock splitter having a slider wedge slidably engaged between a pair of presser cheeks and actuated hydraulically for wedging the presser cheeks apart from each other in a drill hole.

In a hydraulic rock splitter of the type under consideration, as heretofore constructed, the slider wedge is rigidly coupled to the depending piston rod of a hydraulic cylinder assembly, whereas the pair of presser cheeks are connected to the cylinder body of the cylinder assembly via two opposed pairs of leaf springs. The presser cheeks together with the slider wedge therebetween is inserted in a drill hole created in the ground. Upon forced descent of the slider wedge by the cylinder assembly, the leaf springs restrain the presser cheeks from longitudinal displacement but allow them to move apart from each other for splitting or breaking up the rock. The leaf springs serve the additional purpose of elastically holding the presser cheeks in proper engagement with the slider wedge.

This known type of rock splitter has several problems arising from the configuration of the leaf springs and their connections to the cylinder body and to the presser cheeks. First of all, as each pair of opposed leaf springs has been spaced a considerable distance from each other, they have been susceptible to great bending stresses when the presser cheeks connected thereto are subjected to uneven tensile forces as by the movements of the split rock. The bending stresses act not only on the leaf springs but also on the slider wedge and the presser cheeks, possibly causing their deformation.

Another problem also manifests itself upon descent of the slider wedge. Each pair of opposed leaf springs tend to spread apart into a flaring shape when the presser cheeks move away from each other upon descent of the slider wedge. In the prior art rock splitter, however, the presser cheeks have their top end portions keyed to the opposite sides of the slider wedge. The keys restrict the spreading motion of the presser cheeks with respect to the wedge. Consequently, as each pair of opposed leaf springs tend to spread apart into a flaring shape as above, their lower end portions, connected to the presser cheeks, are forced to bend toward each other, with the consequent exertion of substantial bending stresses on the keys. The useful life of the keys has therefore been very short.

A further problem of the prior art arises at the time of the withdrawal of the slider wedge following the splitting of the rock. The leaf springs experience longitudinal compressive stresses as the slider wedge is pulled upwardly in sliding contact with the presser cheeks. The greater the frictional resistance offered by the presser cheeks against the upward travel of the slider wedge, the more are the longitudinal compressive stresses on the leaf springs. The leaf springs have conventionally been rigidly coupled to both the cylinder body and the presser cheeks. Thus the compressive stresses have been easy to build up to such an extent as to cause the buckling and, in the worst case, destruction of the leaf springs. The exertion of compressive forces on the leaf springs and the presser cheeks can also take place in the act of rock splitting. On being fractured by the wedging action of the rock splitter, the rock tends to be displaced upwardly. The upward thrust thus imparted to the presser cheeks has been another reason for the possible breaking of the leaf springs and presser cheeks under compression.

SUMMARY OF THE INVENTION

In view of the above discussed problems so far encountered in the art, the present invention provides an improved hydraulic rock splitter designed to effectively prevent the deformation or destruction of the slider wedge, presser cheeks, and leaf springs constituting the important components thereof.

Summarized briefly, the improved rock splitter of this invention comprises a slider wedge coupled to the piston rod of a hydraulic cylinder assembly and extending downwardly therefrom, and a pair of presser cheeks arranged for relative sliding engagement with the opposite sloping edges of the slider wedge. Connecting the presser cheeks and the cylinder body of the cylinder assembly are four pairs of opposed leaf springs, with two pairs disposed on each side of the slider wedge and normally closely held against each other. Each pair of leaf springs have a spacing therebetween and are rigidly coupled at their lower ends to one of the presser cheeks. The upper ends of the four pairs of leaf springs are all coupled to the cylinder body via elastic means normally biasing the leaf springs downwardly. The leaf springs together with the presser cheeks rigidly coupled thereto are displaceable upwardly to a predetermined limit relative to the cylinder body against the bias of the elastic means. Also included are stop means on the cylinder body of the cylinder assembly, adapted to allow upward displacement of the presser cheeks with the leaf springs up to the predetermined limit but to positively restrain the presser cheeks from any further upward displacement with respect to the cylinder body.

It is to be noted that each presser cheek is supported from the cylinder body of the hydraulic cylinder assembly via two pairs of leaf springs disposed on opposite sides of the slider wedge and normally closely held against the other two pairs of leaf springs connecting the other presser cheek to the cylinder body. Each pair of leaf springs are normally in parallel spaced relationship to each other. This improved dual leaf spring configuration successfully avoids the application of any great bending stresses to the slider wedge and the presser cheeks even when the two sets of leaf springs, each consisting of two spring pairs, are loaded unevenly in the operation of the rock splitter. The dual spring arrangement is further effective to limit by itself the spreading of the pair of presser cheeks as upon descent of the slider wedge. Thus protected from undue bending stresses, the keys operatively coupling the presser cheeks to the slider wedge will offer a longer useful life than heretofore.

Further, since the four pairs of leaf springs are connected to the cylinder block via elastic means, the upward thrust of the presser cheeks as at the time of rock splitting can be cushioned without the buckling of the leaf springs.

A still further feature of the invention resides in the stop means which may take the form of several rods having their top ends rigidly coupled to the cylinder block or some equivalent means and their bottom ends held opposite the top ends of the presser cheeks normally with some spacings therebetween. Consequently the presser cheeks are displaceable upwardly with the leaf springs to the extent permitted by the elastic means. Coming into abutment against the stop rods, the presser cheeks are positively locked against any further upward travel. This serves to prevent the buckling of the leaf springs.

The above and other features and advantages of the present invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
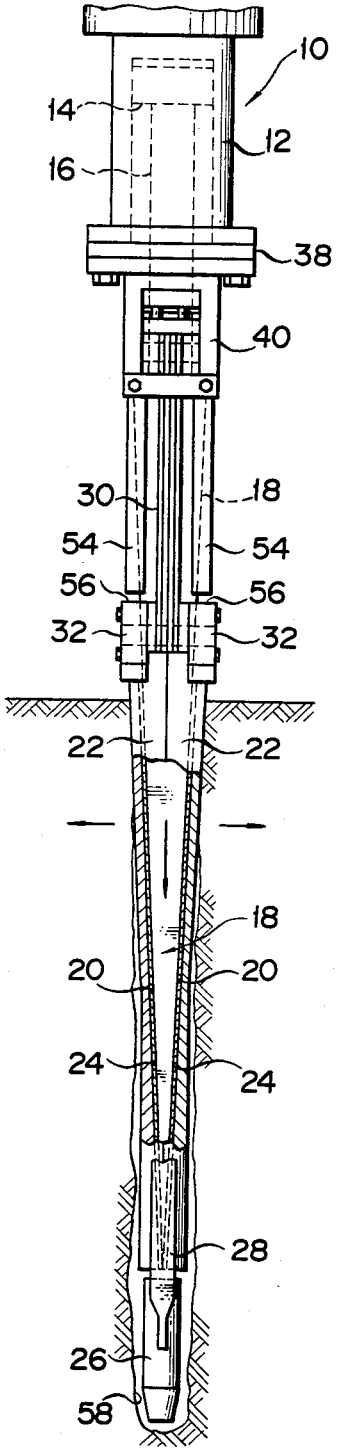
FIG. 1 is a side elevation, partly broken away and shown in section for clarity, of the hydraulic rock splitter constructed in accordance with the novel concepts of the invention, the rock splitter being shown inserted in a drill hole for splitting the rock.

With reference first and in particular to FIG. 1 the reference numeral 10 generally designates a hydraulic cylinder assembly which may be conveniently mounted, for example, to the boom of a track type vehicle. The cylinder assembly 10 has a cylinder body 12 having a piston 14 slidably mounted therein, and a piston rod 16 extending downwardly therefrom. The piston rod 16 is connected collinearly to a slider wedge 18 having a pair of opposite sloping edges 20, such that the slider wedge gradually diminishes in width as it extends downwardly.

At 22 are shown a pair of presser cheeks arranged for relative sliding engagement with the opposite sloping edges 20 of the slider wedge 18 and for movement away from each other upon descent of the slider wedge. The presser cheeks 22 have antifriction linings 24 on their inside surfaces to offer a minimal friction to the sliding motion of the slider wedge 18. Arranged below the presser cheeks 22 are a wedge protector tube 26 supported by a pair of support strips 28, one seen, on the opposite sides of the presser cheeks. The wedge protector tube 26 receives and protects the tip of the slider wedge 18 upon descent thereof.

Figure 2:
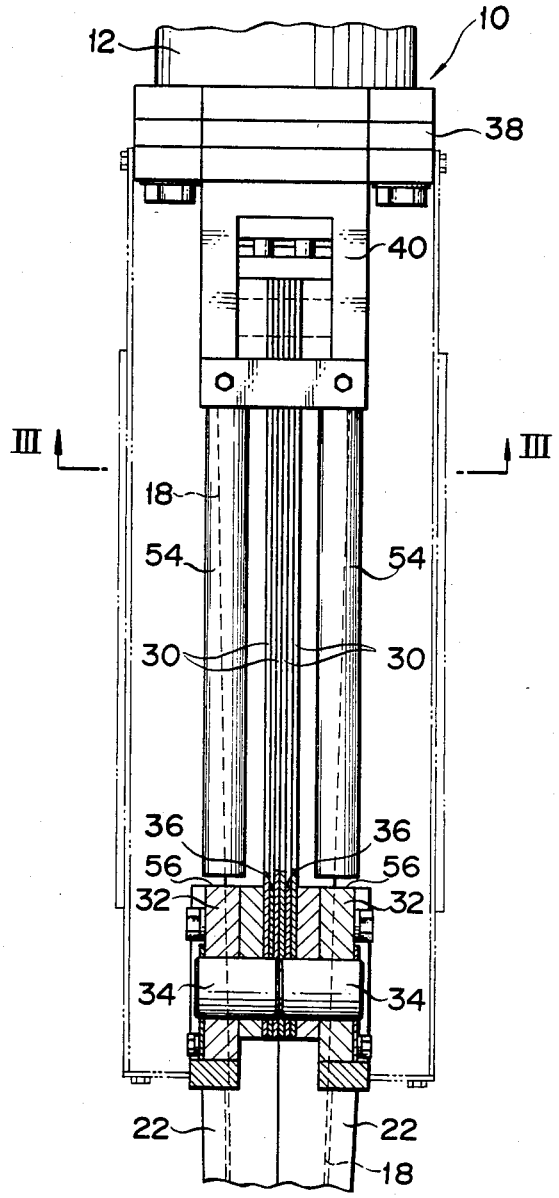
FIG. 2 is an enlarged, fragmentary elevation of the rock splitter of FIG. 1, showing the leaf springs and associated parts thereof in more detail.
Figure 3:
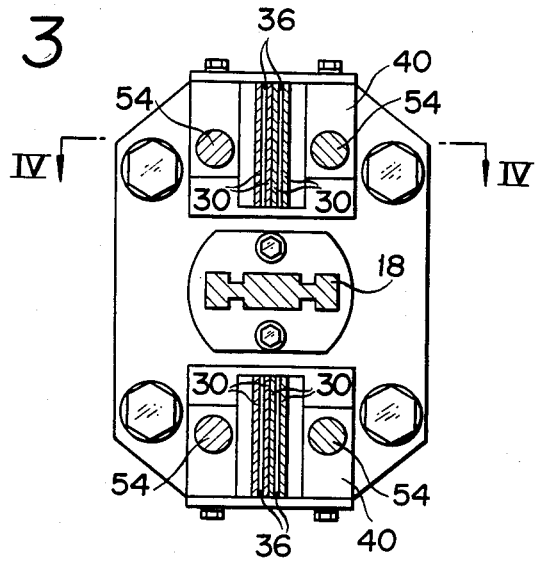
FIG. 3 is a horizontal section through the rock splitter, taken along the line III—III of FIG. 2.

As will be better understood from a consideration of FIGS. 2 and 3, the pair of presser cheeks 22 are each rigidly connected at its top end to the bottom ends of two pairs of opposed leaf springs 30, disposed on the opposite sides of the slider wedge 18, by a connector 32 held sidewise against the presser cheek and by a cross pin 34 extending crosswise through the connector 32, presser cheek 22, and one pair of leaf springs 30. The total of four pairs of leaf springs 30 serve the purpose of connecting the presser cheeks 22 to the cylinder body 12 of the hydraulic cylinder assembly 10 so as to rigidly restrain the presser cheeks from downward displacement in the face of the descent of the slider wedge 18 but to allow the presser cheeks to move apart from each other owing to the wedging action. Each pair of opposed leaf springs 30 have a pair of spacers 36 sandwiched between their opposite ends, so that they are normally in parallel spaced relationship to each other. Further, normally, each pair of leaf springs 30 are more or less closely held against the other pair of leaf springs on the same side of the slider wedge 18.

Figure 4:
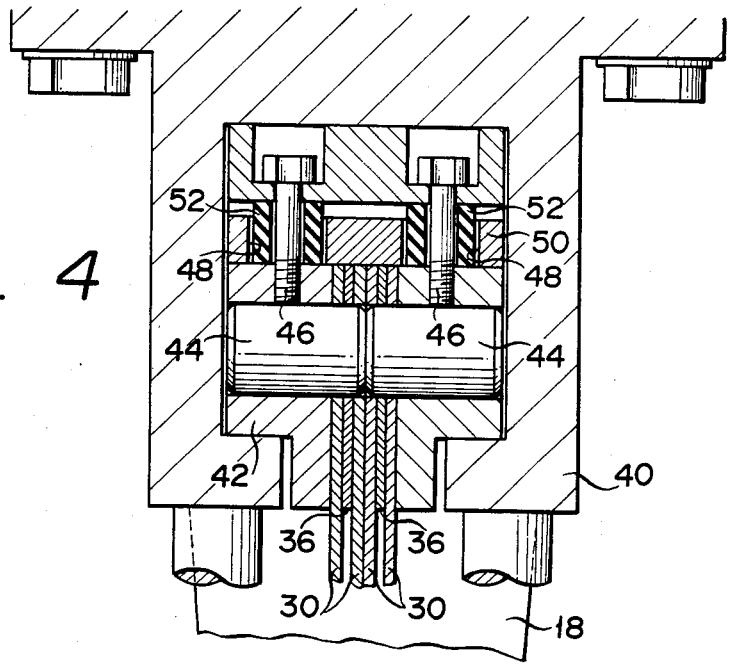
FIG. 4 is a still more enlarged, fragmentary vertical section through the rock splitter, taken along the line IV—IV of FIG. 3 and showing in particular the means for elastically connecting the top ends of the leaf springs to the cylinder body of the hydraulic cylinder assembly.
Figure 5:
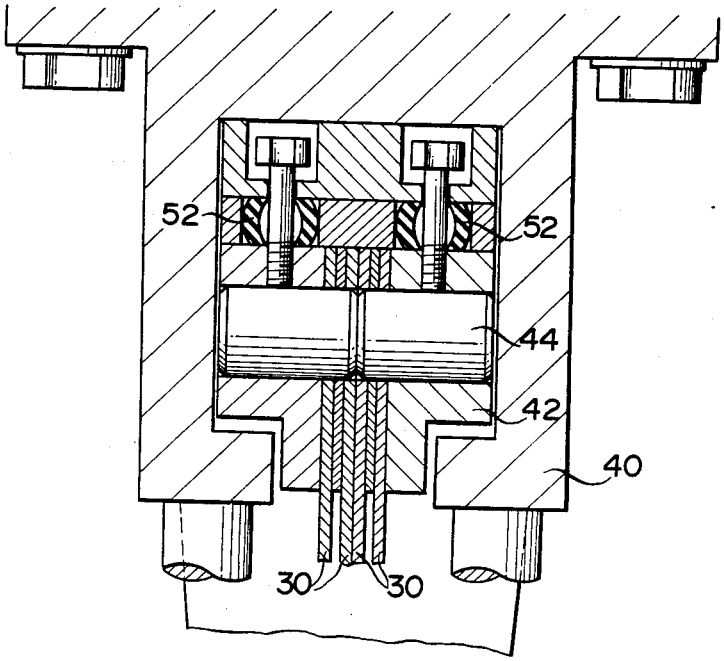
FIG. 5 is a view similar to FIG. 4 except that the leaf springs are shown elastically displaced upwardly.

FIGS. 4 and 5 clearly illustrate the way the four pairs of leaf springs 30 are coupled to the cylinder body 12 of the cylinder assembly 10. It may be mentioned here, in connection with FIGS. 1 and 2, that the cylinder body 12 has a rotary coupling 38 on its bottom end to allow the slider wedge 18, presser cheeks 22, leaf springs 30, etc., to revolve about a common vertical axis, in order that the rock may be wedged apart in any desired direction. The rotary coupling constitutes no essential feature of this invention, however, and as far as the purposes of the invention are concerned, it does not affect in any way the performance of the leaf springs 30 and other associated means. The following discussion of FIGS. 4 and 5 presupposes, therefore, that the cylinder body 12 had no such rotary coupling.

Formed substantially integral with the cylinder body 12, then, are a pair of slide housings 40 one of which is shown sectioned in FIGS. 4 and 5 and both of which are shown in FIG. 3 as seen from below. It will be observed from the latter figure that the slide housings 40 are disposed on the opposite sides of the slider wedge 18 on the underside of the cylinder body 12. FIGS. 4 and 5 reveal a slide or slides 42 mounted within each slide housing 40 for up and down sliding motion within limits. Each slide 42 has one pair of leaf springs 30, together with the upper spacer 36 therebetween, secured thereto as by a cross pin 44. A screw 46 is engaged with each slide 42 and extends upwardly therefrom through a clearance hole 48 in an abutment 50 movable up and down with both slides 42. Interposed between slide housing 40 and slides 42 are elastic means herein shown as tubes of elastomeric material 52, preferably polyurethane rubber of the rigid class, sleeved upon the respective screws 46 and loosely received in the clearance holes 48 in the abutment 50. The elastic tubes 52 normally hold the slides 42 bottomed against the slide housing 40, as shown in FIG. 4, are yieldable to allow upward displacement of the slides with the associated leaf springs 30 until the abutment 50 hits the top of the slide housing as in FIG. 5.

With reference back to FIGS. 1 through 3 the rock splitter in accordance with the present invention further comprises stop means for positively limiting the upward displacement of the presser cheeks 22 relative to the cylinder body 12 of the cylinder assembly 10 after the yielding of the elastic tubes 52. The stop means are herein shown as a pair of stop rods 54 depending from each slide housing 40 and normally terminating short of presser cheek shoulders 56 formed by the aforesaid connectors 32. These presser cheek shoulders are to come into the abutment against the total of two pairs of stop rods 54 upon the yielding of the elastic tubes 52. As has been mentioned, the slide housings 40 could be essentially integral with the cylinder body 12. Accordingly the stop rods 54 might be thought of as depending directly from the cylinder body 12, functioning to positively limit the upward displacement of the presser cheeks 22 with respect to the cylinder body.

In the operation of the above improved rock splitter the pair of presser cheeks 22 with the slider wedge 18 therebetween may be inserted in a drill hole 58, FIG. 1 as usual. The forced descent of the slider wedge 18 by the hydraulic cylinder assembly 10, with its opposite sloping edges 20 sliding over the antifriction linings 24 of the presser cheeks 22, will cause the presser cheeks to move apart from each other by wedging action against the force of the four pairs of leaf springs 30 for splitting or breaking up the rock.

Figure 6:
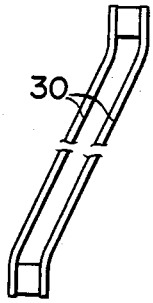
FIG. 6 is an elevation, partly broken away for illustrative convenience, of one pair of leaf springs, the view being explanatory of the performance of the leaf springs.

As the presser cheeks 22 spread apart as above, so do the lower end portions of the leaf springs 30 connected thereto. Each pair of leaf springs 30, rigidly coupled at both ends to the connector 32 and to the slide 42 and held in a parallel spaced relation with each other by the spacers 36, will then be so deformed that its opposite end portions will be approximately parallel to each other as depicted in FIG. 6. This serves to prevent any undue spreading of the upper end portions of the presser cheeks 22 without excessive forces being exerted on the keys connecting the presser cheeks to the slider wedge 18.

The presser cheeks 22 may receive upward forces from the split rock. Thereupon the elastic tubes 52 will yield to allow upward displacement of the presser cheeks 22 with the leaf springs 30, thereby cushioning the upward forces. The shoulders 56 of the presser cheeks 22 will come into abutment against the stop rods 54 upon full yielding of the elastic tubes 52. Then the stop rods 54 prevent any further upward displacement of the presser cheeks 22 to protect the leaf springs 30 from buckling and consequent destruction.

Upon completion of rock splitting, the slider wedge 18 may be withdrawn by contracting the hydraulic cylinder assembly 10. The presser cheeks 22 will then tend to move upwardly by friction with the slider wedge 18 but will be prevented from such movement by the leaf springs 30, to which the upward forces will be transmitted largely in their longitudinal direction. The upward forces will tend to buckle the leaf springs. However, since the two pairs of leaf springs 30 connected to each presser cheek 22 are closely held against the other two pairs of leaf springs connected to the other presser cheek, the four pairs of leaf springs will conjointly resist the upward forces despite a possible difference between the forces applied from both presser cheeks. Here again the elastic tubes 52 may yield by the compressive load on the leaf springs 30, and the stop rods 54 will function to positively arrest the upward displacement of the presser cheeks upon full yielding of the elastic tubes. No significant bending stresses will thus be applied to the leaf springs 30, presser cheeks 22, and slider wedge 18.

It is understood that the above described embodiment of the invention is by way of example only and is not to impose limitations upon the invention. A variety of modifications or alterations of the embodiment will readily occur to one skilled in the art without departing from the scope of the invention as expressed in the following claims.

What is claimed is:

1. A hydraulic rock splitter comprising:

(a) a hydraulic cylinder assembly having a cylinder body and a piston rod directed downwardly therefrom;

(b) a slider wedge coupled to the piston rod of the cylinder assembly and extending downwardly therefrom, the slider wedge being thrusted downwardly by the cylinder assembly;

(c) a pair of presser cheeks adapted for insertion in a drill hole and arranged for relative sliding engagement with opposite sloping edges of the slider wedge so as to laterally move away from each other upon downward thrust of the slider wedge by the cylinder assembly;

(d) two pairs of opposed leaf springs disposed on each side of the slider wedge for connecting the pair of presser cheeks to the cylinder body of the cylinder assembly so as to allow the presser cheeks to move away from each other, each pair of leaf springs being rigidly connected at lower ends thereof to one of the presser cheeks, being spaced from each other, and being normally closely held against the other pair of leaf springs on the same side of the slider wedge;

(e) elastic means interposed between the upper ends of the leaf springs and the cylinder body of the cylinder assembly so as to allow upward displacement of the leaf springs together with the presser cheeks to a predetermined limit relative to the cylinder body; and (f) stop means on the cylinder body of the cylinder assembly adapted to allow the upward displacement of the presser cheeks with the leaf springs up to the predetermined limit but to positively arrest any further upward displacement of the presser cheeks relative to the cylinder body in order to prevent the buckling of the leaf springs.

2. The hydraulic rock splitter of claim 1 further comprising:

(a) a slide housing formed substantially integral with the cylinder body of the cylinder assembly on each side of the slider wedge;

(b) a slide received in each slide housing for up and down sliding motion within limits and having the upper ends of the two pairs of leaf springs rigidly connected thereto;

(c) the elastic means acting between each slide housing and the slide received therein for biasing the latter downwardly.

3. The hydraulic rock splitter of claim 1 wherein the stop means comprises a plurality of stop rods depending from the cylinder body of the cylinder assembly and normally terminating short of the presser cheeks, the presser cheeks moving into abutment against the stop rods upon yielding of the elastic means.

4. The hydraulic rock splitter of claim 1 wherein the elastic means comprises members of elastometric material.

* * * * *